United States Patent [19]

Gunneman

[11] 4,153,992

[45] May 15, 1979

[54] CUTTING SCISSORS PARTICULARLY FOR THE CUTTING OF YARNS

[75] Inventor: Paul Gunneman, Helmond, Netherlands

[73] Assignee: Ruti-te Strake B.V., Deurne, Netherlands

[21] Appl. No.: 852,590

[22] Filed: Nov. 17, 1977

[30] Foreign Application Priority Data

Nov. 17, 1976 [NL] Netherlands ..... 7612810

[51] Int. Cl.[2] ..... B26B 13/02

[52] U.S. Cl. ..... 30/253; 30/268

[58] Field of Search ..... 30/260, 266, 268, 267, 30/214, 234, 253

[56] References Cited

U.S. PATENT DOCUMENTS

| | | | |
|---|---|---|---|
| 1,862,079 | 1/1932 | Gilstrap | 30/266 X |
| 1,956,588 | 5/1934 | Parker | 30/260 |
| 4,048,721 | 9/1977 | Gunson | 30/268 |

*Primary Examiner*—Jimmy C. Peters

*Attorney, Agent, or Firm*—Marshall & Yeasting

[57] ABSTRACT

A cutting scissors particularly for cutting yarns, having cutting edges provided on rigid scissors blades, whereby the cutting edge or edges respectively is (are) set in a connecting frame secured to the relative scissors blade at the side thereof remote from the other scissors blade, the setting portion for the blade edge bending around the rim of the scissors blade and being connected through a narrowed flexible transition portion to the securing portion of the frame.

2 Claims, 2 Drawing Figures

CUTTING SCISSORS PARTICULARLY FOR THE CUTTING OF YARNS

Figure 1:
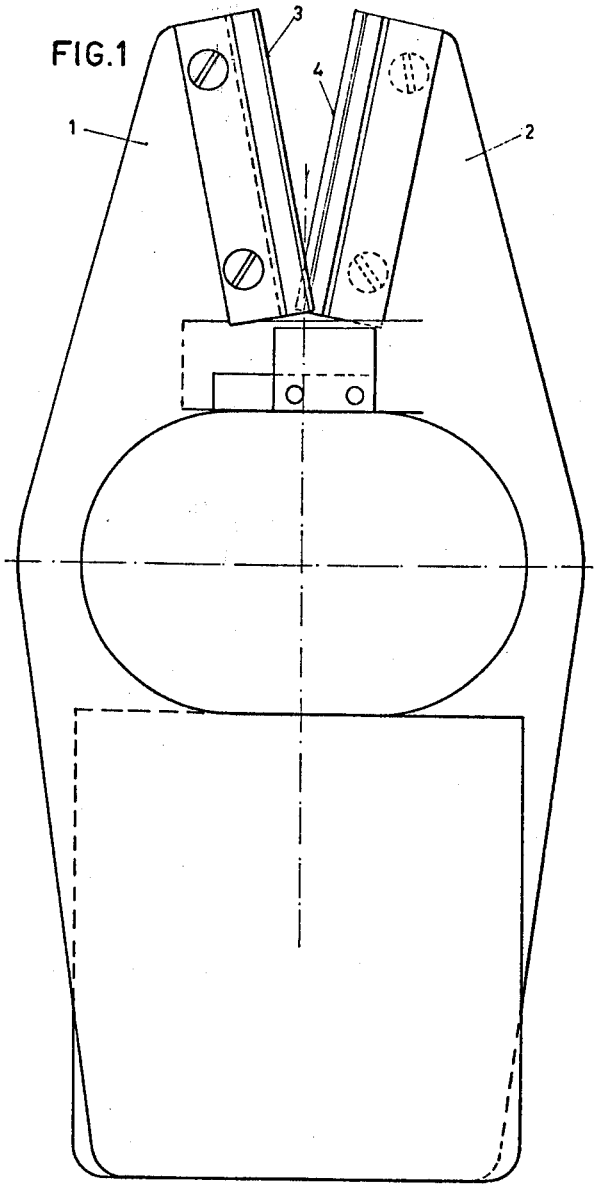

The invention relates to a cutting scissors particularly for the cutting of yarns, having cutting edges provided on rigid scissors blades.

Cutting devices are already known in which at least one of a cooperating pair of knives is pivotally mounted, the arrangement being such that the reaction force produced by the pressure on the object to be cut results in a moment around the pivot axis which forces the knives more strongly into engagement which each other. Such a cutting device is e.g. known embodied in a mowing machine in which the movable knife as a whole is mounted spring supported and pivotable.

The invention aims at using this principle known per se for improving a cutting scissors adapted more particularly for cutting yarns in yarn processing machines.

According to the invention this aim is achieved is that the cutting edge or the cutting edges respectively is (are) set in a connecting frame secured to the relative scissors blade at the side thereof remote from the other scissors blade, in which the blade edge setting portion bends around the rim of the scissors blade and is connected through a narrowed flexible transition portion to the securing portion of the frame.

Extensive experiments have shown that such a cutting scissors is very suitable for cutting yarns of varying thickness and elasticity while the principle of the self adjusting engagement pressure between the cooperating knives is especially advantageous when cutting yarns in more or less stretched conditions.

In a preferably used embodiment the setting portion for the blade edge of one of the scissors blades contacts the rim of the relative scissors blade in a non-stretched condition whereas for the other scissors blade a spacing is provided between the end rim of that scissors blade and the setting portion for the blade edge. In this manner the blade edge in the setting portion engaging the rim of the scissors blade behaves as a substantially fixed blade edge with for the rest an identical construction of both scissors blades.

The invention is hereunder illustrated with reference to the drawing of an embodiment given as example.

Figure 2:
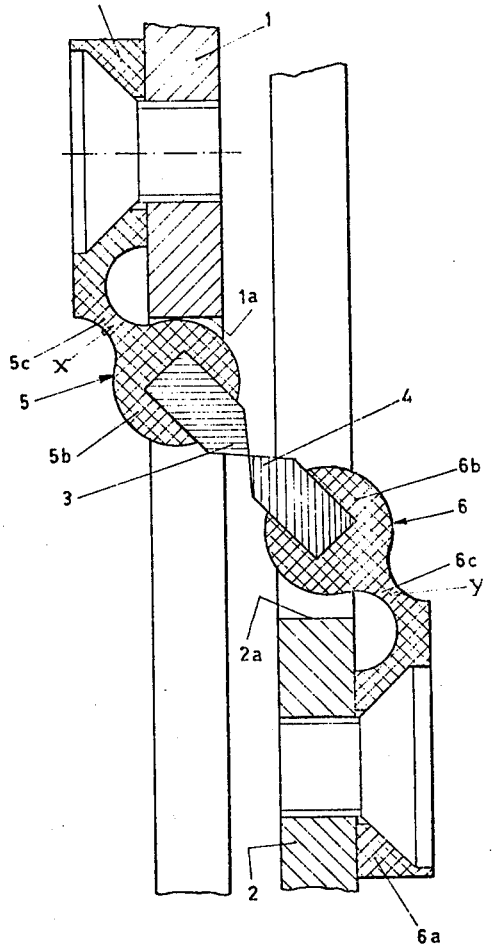

FIG. 1 shows a view of a cutting knife of an embodiment known per se in which the blade edges are constructed according to the invention, and FIG. 2 shows a cross section on a enlarged scale through the cooperating blade edges.

The cutting scissors shown in the drawing comprises mutually hingeable rigid scissors blades 1 and 2 carrying the blade edges indicated 3 and 4 respectively. In the constructions known up till now the blade edges 3 and 4 have been secured to the scissors blades 1 and 2 e.g. by soft soldering. However, according to the invention the blade edges 3 and 4 are each set in a connecting frame 5 and 6 respectively, which e.g. is made from a suitable synthetic material. The connecting frames 5 and 6 each comprise a securing strip 5*a* and 6*a* respectively, a setting portion 5*b* and 6*b* respectively for the blade edge and a narrowed and thereby flexible transition portion 5*c* and 6*c* respectively extending between both mentioned parts. The securing strips 5*a* and 6*a* respectively are secured to the outer sides of scissors blades 1 and 2 respectively, whereas the setting portions 5*b* and 6*b* respectively for the blade edges bend around the mutually facing edges 1*a* and 2*a* of the scissors blades 1 and 2 respectively. By this method of connection the forces (see FIG. 2) generated as reaction forces to the cutting forces imparted by the blade edges will pivot the blade edges 3 and 4 around the pivot points indicated x and y respectively and thereby have them engage each other under pressure. Thereby the setting portion 5*b* soon already engages the rim 1*a* of the scissors blade 1 from which moment on the blade 3 behaves as a fixed blade with respect to the scissors blade 1. It will be clear that according as larger cutting forces are necessary for cutting the yarn and therefor the reaction forces are greater the blades are more strongly forced in engagement with each other under the influence of the moment imparted by the reaction forces around the points x and y respectively. In this manner a cutting scissors with a moderate prestressing pressure between the blade edges is suitable for cutting yarns which for a correct cutting process demand varying minimum engagement pressures between the scissors blades. An engagement pressure between the scissors blades and friction and thereby wear attendant thereon therefore only occurs at the moment of the cutting through whereby the life of the blade edges is considerably increased.

I claim:

1. A cutting scissors particularly for cutting yarns, having cutting edges provided on rigid scissors blades each having a rim, characterized in that the cutting edges are set in connecting frames having securing portions secured to the respective scissors blade at the side thereof remote from the other scissors blade, each connecting frame also having a setting portion for the respective blade edge bending around the rim of the scissors blade and a narrowed flexible transition portion connecting the securing portion to the setting portion, the flexible portion providing said bending action.

2. A cutting scissors according to claim 1, characterized in that the setting portion for the blade edge of one of the connecting frames in the non-stretched condition engages or substantially engages the rim of the corresponding scissors blade.

* * * * *